United States Patent [19]

Rees

[11] 4,084,535

[45] Apr. 18, 1978

[54] APPARATUS FOR CLEANING SUBMERGED SURFACES

[75] Inventor: Robin Gore Rees, Portmarnock, Ireland

[73] Assignee: Institute for Industrial Research and Standards, Dublin, Ireland

[21] Appl. No.: 770,430

[22] Filed: Feb. 22, 1977

[30] Foreign Application Priority Data

| | | |
|---|---|---|
| Mar. 1, 1976 | Ireland | 409/76 |
| Aug. 26, 1976 | Ireland | 1910/76 |

[51] Int. Cl.[2] ..... B63B 59/00

[52] U.S. Cl. ..... 114/222; 15/1.7; 15/50 R; 51/24

[58] Field of Search ..... 114/222; 15/1.7, 49 R, 15/50 R; 51/177, 24, 16

[56] References Cited

U.S. PATENT DOCUMENTS

| | | | |
|---|---|---|---|
| 2,104,062 | 1/1938 | Temple | 114/222 |
| 2,923,956 | 2/1960 | Bixler | 15/50 R |
| 3,088,429 | 5/1963 | Johannessen | 114/222 |
| 3,407,422 | 10/1968 | Otto et al. | 15/49 R |
| 3,561,391 | 2/1971 | Locati | 114/222 |
| 3,781,937 | 1/1974 | Jacobs | 15/49 R |

FOREIGN PATENT DOCUMENTS

| | | | |
|---|---|---|---|
| 2,003,003 | 7/1971 | Germany | 114/222 |

*Primary Examiner*—Trygve M. Blix
*Assistant Examiner*—Stuart M. Goldstein
*Attorney, Agent, or Firm*—Diller, Brown, Ramik & Wight

[57] ABSTRACT

The present invention provides an apparatus for cleaning submerged surfaces. In the apparatus two rotary brushes are supported side-by-side by a frame and provided with drive mechanisms to rotate the brushes in opposite directions; the brushes are each provided with a handle such that in use by a diver the brushes may be independently pivoted relative to the frame in such manner that each brush may be inclined towards or away from each other, to control the cleaning action of the apparatus and the movement of the apparatus relative to the surface to be cleaned.

The apparatus may also incorporate mechanisms for the application of paint to a submerged and cleaned surface.

2 Claims, 3 Drawing Figures

APPARATUS FOR CLEANING SUBMERGED SURFACES

This invention relates to an apparatus for cleaning and/or painting submerged surfaces, and in particular to an apparatus for brushing the submerged surfaces of ships, boats, offshore rigs and the like.

BACKGROUND

Hitherto, such apparatus has generally been one of two types. These are single rotary brush pneumatic or hydraulic machines and triple rotary brush machines which are usually hydraulic. The disadvantages of the single brush machines are that the divers operating them have to resist the reaction torque of the brushes and are thus quickly fatigued, and that it is time-consuming to cover large areas. The triple brush machines are much larger and more powerful and usually have separate hydraulic propulsion motors and steerable wheels to render them capable of control by divers. The disadvantages, however, are that they are costly, cumbersome and only really effective on long straight runs on flat surfaces. All the curved surfaces are more efficiently done with a hand-held single brush machine. Triple brush machines are also extremely heavy out of water and need cranes and trailers to remove and transport them.

SUMMARY

According to this invention there is provided an apparatus for cleaning submerged surfaces, comprising two rotary brushes supported side-by-side by a frame, the brushes being independently pivoted with respect to the frame in such manner that each brush may be inclined towards or away from the other, a respective handle associated with each brush by which such pivotal movement may be effected manually, and drive means for the brushes arranged to rotate the brushes in opposite directions.

The cleaning apparatus of the present invention may be modified to facilitate the application of paint to a submerged surface, the drive means for the brushes being provided with paint supply means comprising hollow shafts each connected via supply pipes to a paint supply unit, said paint supply means having associated therewith pump means to supply paint from the said paint supply unit to the centre portion of each of the brushes.

BRIEF DESCRIPTION OF THE DRAWINGS

The invention will be more clearly understood from the following description of an embodiment thereof given by way of example only with reference to the accompanying drawings in which.

DESCRIPTION OF THE PREFERRED EMBODIMENT

Figure 1:
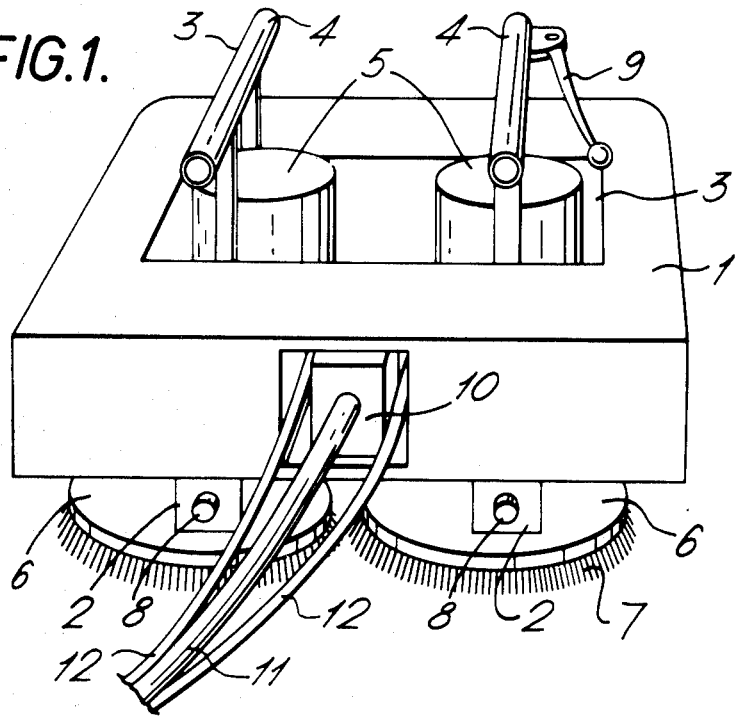
FIG. 1 is a perspective view of the apparatus.

Referring to FIG. 1, there is provided a frame member 1, having the shape of a hollow rectangle, which is of sealed hollow construction in order to provide buoyancy. Frame member 1 is provided with two pairs of pivot bearings 2 which support two brushing units 3 in such a fashion that the brushing units 3 are free to tilt towards or away from each other when urged by manual force applied to handles 4 affixed to each unit. Each brushing unit comprises a driving motor 5 which may be either pneumatically or hydraulically powered, a flat disc 6 one face of which is provided with brush filling material 7, the disc 6 being concentrically fixed to the driven shaft of the driving motor 5, a handle 4 which is rigidly fixed to the driving motor 5 and stub shafts 8 which are rigidly fixed to the driving motor 5 and which are embraced by the pivot bearings 2. As is apparent from FIGS. 1 and 3, the shafts 8 carried by the two motors 5 are parallel to one another whereby pivoting of the brushing units is limited to movement towards and away from one another. A lever 9 serving as a throttle is pivotally fixed to one of the handles 4. Operation of the lever 9 actuates a control valve 10 in a conventional manner by way of a control cable or the like (not shown) which allows exhaust fluid to pass from the motors 5 to the exhaust tubes 11. Motive fluid from the supply tubes 12 passes foward to the motors 5. Valve 10 is biassed in such a way that when lever 9 is released, valve 10 closes to prevent exhaust fluid from escaping from motors. The arrangement of the tubes 11 and 12 and the motors 5 is such that the motors and brushes always rotate in opposite directions.

Figure 2:
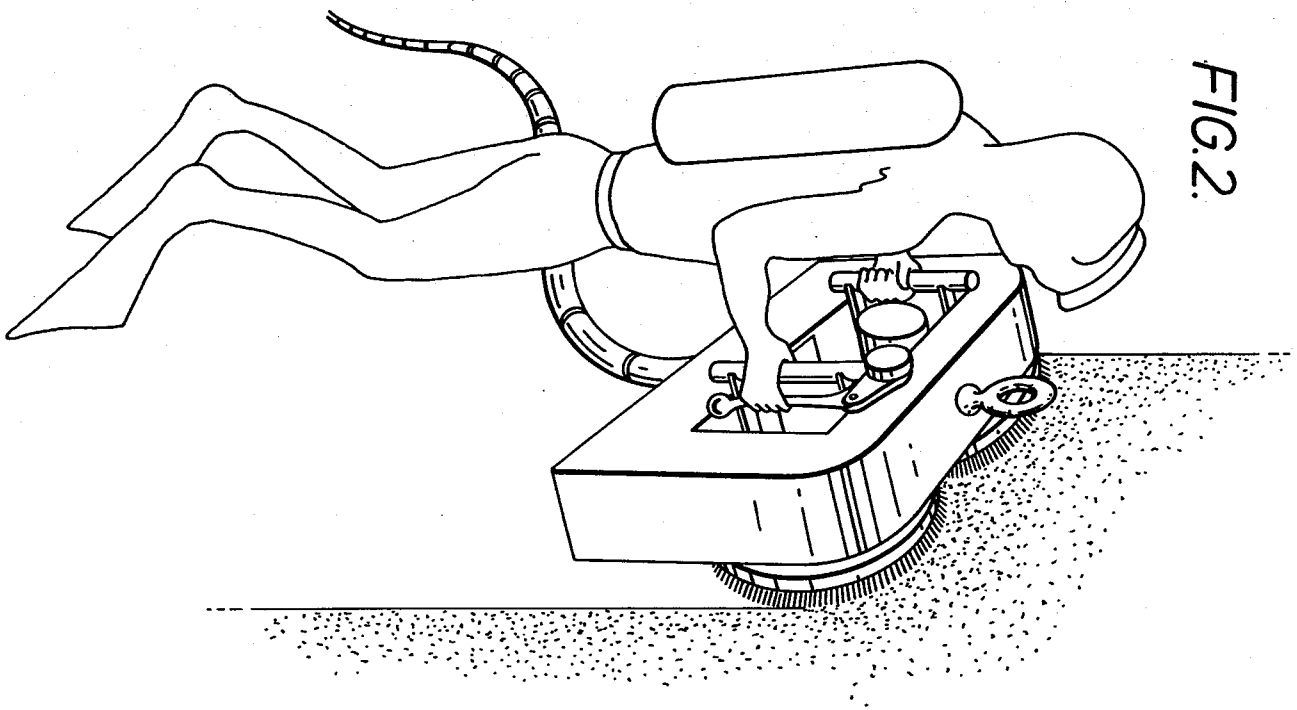
FIG. 2 illustrates the apparatus being used by a diver.

Referring to FIG. 2, a pictorial representation of a pneumatically-powered cleaning apparatus being used by a diver to clean a foulded surface is given.

In use the cleaning apparatus is brought by a diver into close proximity with a surface to the cleaned, and the brushes are made to rotate. The rotation of the brushes produces a centrifugal force on the water which causes it to be expelled radially by the brushes. This produces a partial vacuum at the centre of each brush causing the brushes to be drawn into contact with the dirty surface. Because the brushes 6 are rotating in opposite direction, there is no reaction torque to be borne by the diver. When he wishes to cause the apparatus to move the surface to be cleaned, the diver may either pull the handles 4 apart, causing the furthest apart edges of the two brushes 6 to press harder against the dirty surface, or he may pull the handles 4 together, causing the brush edges which are closest together to press harder against the dirty surface. Because the furthest-apart edges are both travelling in the same direction and the closest-together edges are both travelling the opposite direction, there will be a pull in one direction or the opposite direction, the direction being normal to the line joining the two brush centres if each brush is rotating at the same speed, if the brushes are identical and in contact with surfaces of similar roughness, and if the force exerted on each handle is the same. Adjustment of any of the above variables may cause the apparatus to travel along a curved path, or to turn on the axis of one of the brushes or any other axis.

Thus, by controlling the speed of the brushes and the force on each handle, a diver may manoeuvre the apparatus at various speeds, along various paths and may reverse the direction of motion without changing the speed or direction of the motors.

It will be appreciated that, because the two brushing units are pivotally mounted, the apparatus is free to travel over both convex and concave surfaces, as well as flat surfaces, with equal facility.

The description of the apparatus above refers specifically to the use of two rotary brushes supported side-by-side by a frame. It will be understood that the invention also embraces the use in the apparatus of more than one pair of brushes for example the use of four brushes, namely, two pairs of brushes, suitably mechanically linked to provide the necessary tilting motion. It will also be understood that the apparatus may be propelled sideways by tilting the brush axes in opposite directions in parallel planes.

Figure 3:
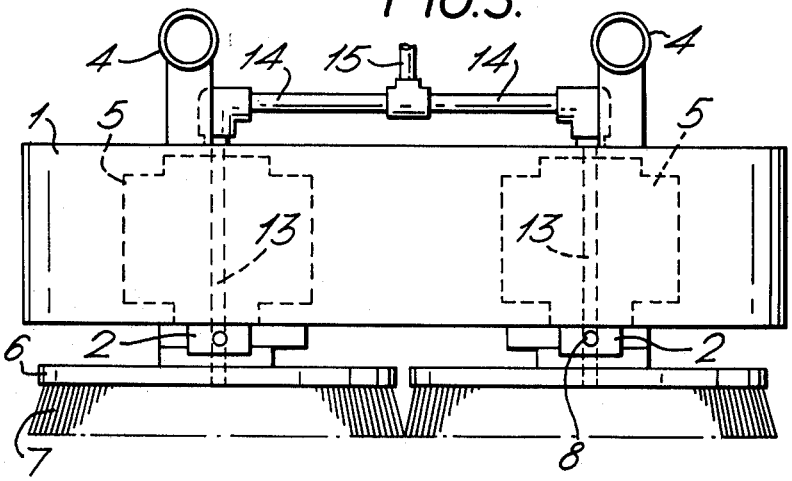
FIG. 3 illustrates a modified apparatus to facilitate the application of paint to a submerged surface

Referring to FIG. 3 of the accompanying drawings there is schematically illustrated a modified apparatus to facilitate the application of paint to a submerged and cleaned surface. In the modified apparatus the motors 5 are each provided with a hollow shaft 13 each connected via suitable supply pipes 14 and 15 to a paint supply unit (not shown). The hollow shafts 13 supplies the paint under a pumping action, applied in any conventional and convenient manner, to the centre portion of each of the brushes 7 for application to the cleaned surface to the painted.

In applying paint to a cleaned surface the diver follows the same basic procedure as followed in the cleaning operation. The paint used is especially designed for very rapid drying and for application to submerged surfaces in the manner described.

I claim:

1. An apparatus for cleaning submerged surfaces, said apparatus comprising a frame, two rotary brushes, mounting means mounting said rotary brushes on said frame in side-by-side relation and for independent pivotal movement with respect to said frame for inclination towards or away from the other, a handle associated with each brush for manually effecting pivotal movement of each brush, and drive means connected to said brushes for rotating said brushes in opposite directions, said drive means including a separate motor for each brush, each motor having a shaft, said motors forming part of said mounting means with each brush being mounted on the shaft of its respective motor, each brush, motor and respective handle forming a brushing unit, said frame defining an aperture for said brushing units with each brushing unit being mounted for pivoting as a whole in said aperture, and each brush projecting from said aperture on one side of said frame and each handle projects from said aperture on an opposite side of said frame.

2. An apparatus according to claim 1, in which said frame is of sealed hollow construction to provide buoyancy.

* * * * *